US009342961B2

(12) United States Patent
Kim

(10) Patent No.: US 9,342,961 B2
(45) Date of Patent: May 17, 2016

(54) GAMING SYSTEM AND A METHOD OF GAMING

(75) Inventor: Hyong Joo Kim, Meadowbank (AU)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 745 days.

(21) Appl. No.: 12/276,021

(22) Filed: Nov. 21, 2008

(65) Prior Publication Data

US 2009/0197667 A1 Aug. 6, 2009

(30) Foreign Application Priority Data

Nov. 23, 2007 (AU) ..... 2007906425

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3262* (2013.01)

(58) Field of Classification Search

CPC ..... G06F 17/32; G06F 17/34; G06F 17/3244; G06F 17/3262; G06F 17/3211

USPC ..... 463/16–31, 40–42

See application file for complete search history.

(56) References Cited

U.S. PATENT DOCUMENTS

| | | | | |
|---|---|---|---|---|
| 2004/0242315 | A1 | 12/2004 | Paulsen et al. | |
| 2006/0154717 | A1* | 7/2006 | Jackson | 463/20 |
| 2007/0129130 | A1 | 6/2007 | Sato | |
| 2007/0129132 | A1 | 6/2007 | Seelig | |
| 2007/0129139 | A1 | 6/2007 | Nguyen | |
| 2007/0205559 | A1 | 9/2007 | Webb | |
| 2007/0213135 | A1 | 9/2007 | Aida | |
| 2007/0218978 | A1 | 9/2007 | Toyoda | |
| 2007/0218983 | A1 | 9/2007 | Lombardo | |
| 2007/0218986 | A1 | 9/2007 | Van Luchene | |
| 2007/0219000 | A1 | 9/2007 | Aida | |
| 2007/0222156 | A1 | 9/2007 | Ornstein et al. | |
| 2007/0228655 | A1 | 10/2007 | Teeple | |
| 2007/0287523 | A1* | 12/2007 | Esses et al. | 463/20 |
| 2009/0117989 | A1* | 5/2009 | Arezina et al. | 463/20 |

FOREIGN PATENT DOCUMENTS

| | | |
|---|---|---|
| GB | 2436162 | 9/2007 |
| GB | 2436724 | 10/2007 |
| JP | 2007111366 | 5/2007 |
| JP | 2007111367 | 5/2007 |
| JP | 2007111368 | 5/2007 |
| JP | 2007117316 | 5/2007 |
| JP | 2007117500 | 5/2007 |
| JP | 2007125056 | 5/2007 |
| JP | 2007130509 | 5/2007 |

* cited by examiner

*Primary Examiner* — Masud Ahmed
(74) *Attorney, Agent, or Firm* — Armstrong Teasdale LLP

(57) ABSTRACT

A method of gaming including: providing at least one set of player selectable symbols; receiving at least one player selection of a symbol from the at least one set of symbols; forming at least one reel strip including the at least one selected symbol; generating a game outcome from a set of reels including the at least one reel strip; and evaluating the game outcome to determine whether to make an award.

34 Claims, 8 Drawing Sheets

| | | |
|---|---|---|
| K | A | 10 |

Figure 9

| | | |
|---|---|---|
| PIC2 | A | K |

Figure 10

| | | |
|---|---|---|
| Q | PIC3 | 10 |

Figure 11

| | | |
|---|---|---|
| PIC5 | PIC2 | 10 |

Figure 12

GAMING SYSTEM AND A METHOD OF GAMING

CROSS-REFERENCE TO RELATED APPLICATIONS

The present application claims the benefit of priority to Australian Provisional Patent Application No. 2007906425, filed on Nov. 23, 2007, entitled "A GAMING SYSTEM AND A METHOD OF GAMING", which is herein incorporated by reference in its entirety.

FIELD OF THE INVENTION

This invention relates to a gaming system, a method of gaming, a game controller and computer program code.

BACKGROUND OF THE INVENTION

Many different gaming systems are known in which symbols are displayed in order to provide a game on which a wager can be made. Typically such games are played on so-called "poker machines". Usually the symbols are displayed on a mechanical reel, or in more recent times on a video display. A winning game is determined based on the displayed symbols.

While such gaming systems provide users with enjoyment, a need exists for an alternative gaming system in order to maintain or increase player enjoyment.

SUMMARY OF THE INVENTION

Certain embodiments of the present invention may be said to reside in a method of gaming including:

- providing at least one set of player selectable symbols;
- receiving at least one player selection of a symbol from the at least one set of symbols;
- forming at least one reel strip including the at least one selected symbol;
- generating a game outcome from a set of reels including the at least one reel strip; and
- evaluating the game outcome to determine whether to make an award.

In an embodiment, the method includes randomly generating the at least one set of selectable symbols from a source set of symbols.

In an embodiment, providing at least one set of selectable symbols includes generating a plurality of sets of selectable symbols.

In an embodiment, the step of receiving a player selection of at least one symbol includes allowing the player to select one symbol from each set of selectable symbols.

In an embodiment, the selected symbols are inserted into the at least one reel strip in place of symbols already on the reel strip.

In an embodiment, the selected symbols are added to the at least one reel strip in addition to symbols already part of the reel strip.

In an embodiment, a new reel of symbols is formed from the selected symbols.

In an embodiment, forming at least one reel strip includes forming a plurality of reel strips.

In an embodiment, the step of forming includes including each selected symbol in each reel strip.

In an embodiment, the method includes determining whether a condition is met prior to generating a game outcome with the at least one reel strip including the selected symbol.

In an embodiment, the condition is that a feature is triggered such that the at least one reel strip including the selected symbol is employed in a feature game.

Certain embodiments of the present invention also provide a game controller for a gaming system, the game controller arranged to:

- provide at least one set of player selectable symbols;
- receive at least one player selection of a symbol from the at least one set of symbols;
- form at least one reel strip including the at least one selected symbol;
- generate a game outcome from a set of reels including the at least one reel strip; and
- evaluate the game outcome to determine whether to make an award.

In an embodiment, the game controller is arranged to randomly generate the at least one set of selectable symbols from a source set of symbols.

In an embodiment, the game controller is arranged to provide the at least one set of selectable symbols by generating a plurality of sets of selectable symbols.

In an embodiment, the game controller is arranged to allow the player to select one symbol from each set of selectable symbols.

In an embodiment, the game controller is arranged to insert the selected symbols into the at least one reel strip in place of symbols already on the reel strip.

In an embodiment, the game controller is arranged to add selected symbols to the at least one reel strip in addition to symbols already part of the reel strip.

In an embodiment, the game controller is arranged to form a new reel of symbols from the selected symbols.

In an embodiment, the game controller is arranged to form a plurality of reel strips.

In an embodiment, the game controller is arranged to form the plurality of reel strips by including each selected symbol in each reel strip.

In an embodiment, the game controller is arranged to determine whether a condition is met prior to generating a game outcome with the at least one reel strip including the selected symbol.

In an embodiment, the condition is that a feature is triggered such that the at least one reel strip including the selected symbol is employed in a feature game.

In an embodiment, the game controller is implemented by a processor executing program code stored in a memory.

Certain embodiments of the present invention also provide a gaming system including:

- a player interface including a display for displaying game outcomes and a game play mechanism; and
- a game controller arranged to:
  - provide at least one set of player selectable symbols for selection by displaying the symbols on the display;
  - receive from the game play mechanism, at least one player selection of a symbol from the at least one set of symbols;
  - form at least one reel strip including the at least one selected symbol;
  - generate a game outcome from a set of reels including the at least one reel strip for display on the display; and
  - evaluate the game outcome to determine whether to make an award.

In an embodiment, the game controller is arranged to randomly generate the at least one set of selectable symbols from a source set of symbols.

In an embodiment, the game controller is arranged to provide the at least one set of selectable symbols by generating a plurality of sets of selectable symbols.

In an embodiment, the game controller is arranged to allow the player to select one symbol from each set of selectable symbols.

In an embodiment, the game controller is arranged to insert the selected symbols into the at least one reel strip in place of symbols already on the reel strip.

In an embodiment, the game controller is arranged to add selected symbols to the at least one reel strip in addition to symbols already part of the reel strip.

In an embodiment, the game controller is arranged to form a new reel of symbols from the selected symbols.

In an embodiment, the game controller is arranged to form a plurality of reel strips.

In an embodiment, the game controller is arranged to form the plurality of reel strips by including each selected symbol in each reel strip.

In an embodiment, the game controller is arranged to determine whether a condition is met prior to generating a game outcome with the at least one reel strip including the selected symbol.

In an embodiment, the condition is that a feature is triggered such that the at least one reel strip including the selected symbol is employed in a feature game.

In an embodiment, the gaming system includes a processor executing program code stored in a memory to implement the game controller.

The invention also provides computer program code which when executed by a processor implements the above method (s).

Certain embodiments of the present invention also provide a computer readable medium including the program code.

Certain embodiments of the present invention also provide a data signal including the program code.

Certain embodiments of the present invention also extend to transmitting the program code.

BRIEF DESCRIPTION OF DRAWINGS

Certain embodiments of the present invention will be described, by way of example, with reference to the accompanying drawings in which:

FIG. 9, FIG. 10, FIG. 11 and FIG. 12 are views showing further sets of second symbols for player selection;

Figure 1:
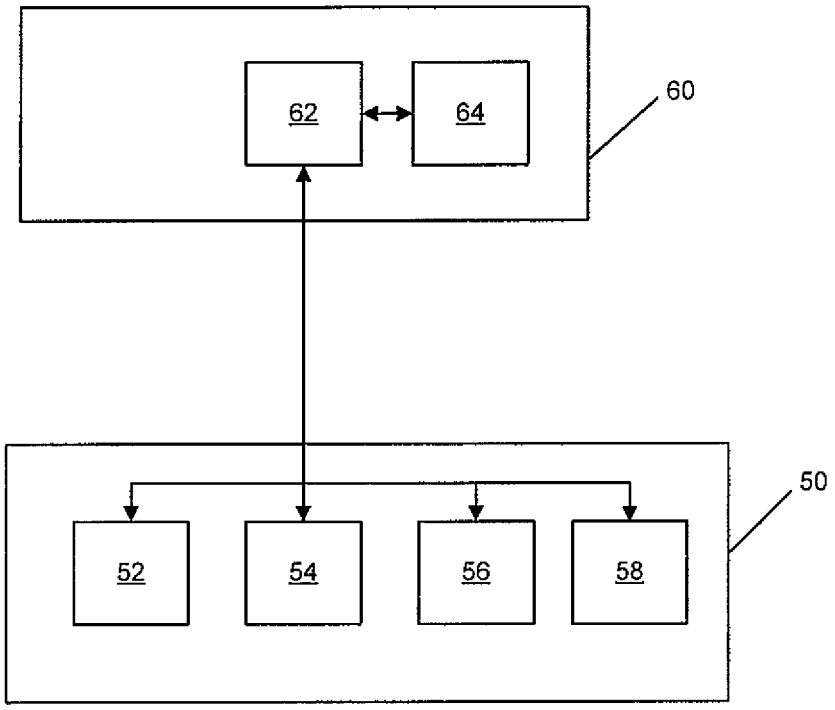
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF CERTAIN EMBODIMENTS

Referring to the drawings, there is shown a gaming system arranged to implement a game where a player can participate in forming a reel strip used at least during part of the game. The gaming system can take a number of different forms.

In a first form, a stand alone gaming machine is provided wherein all or most components for implementing the game are present in a player operable gaming machine.

In a second form, a distributed architecture is provided wherein some of the components for implementing the game are present in a player operable gaming machine and some of the components for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system includes several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions and play the game.

Components of the player interface may vary from embodiment to embodiment but will typically include a credit mechanism 52 to enable a player to input credits and receive payouts, one or more displays 54, a game play mechanism 56 that enables a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
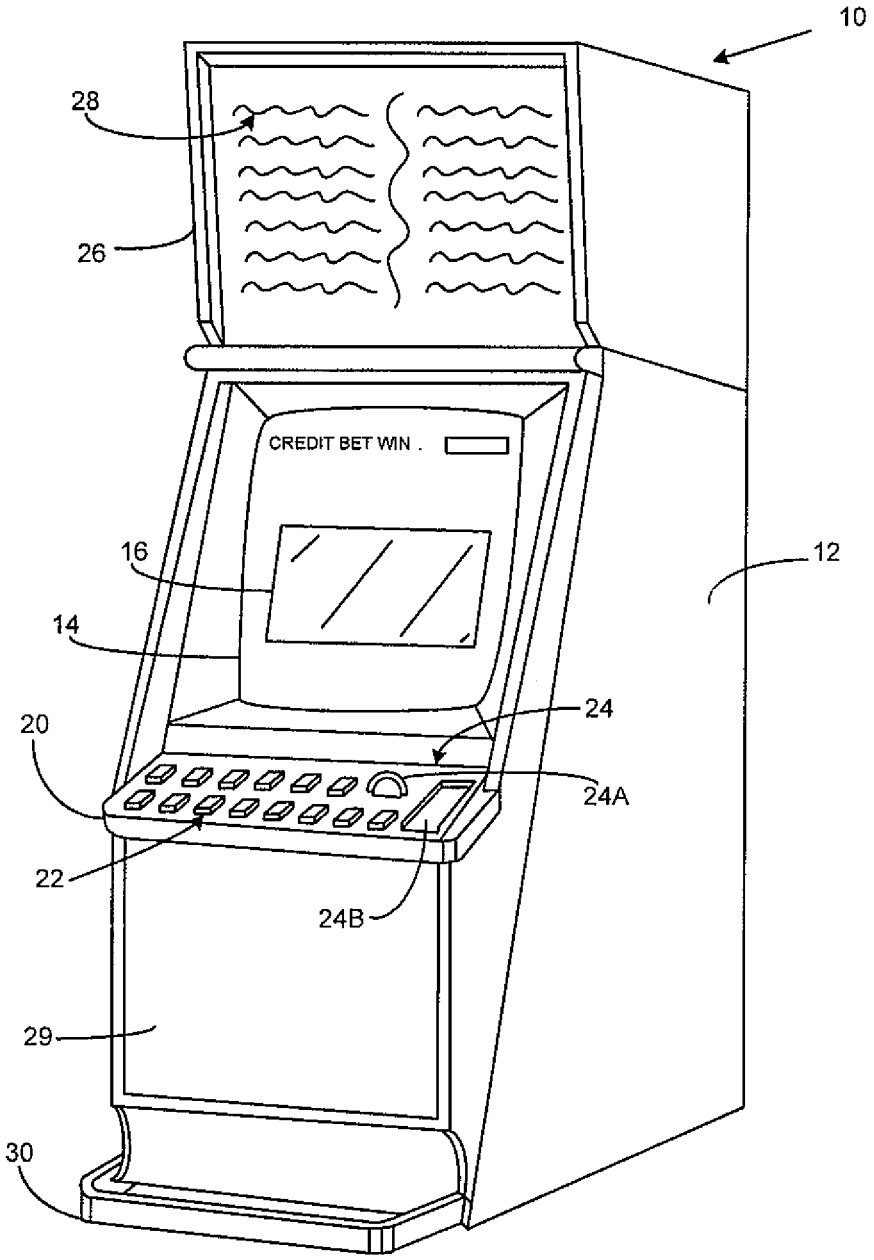
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
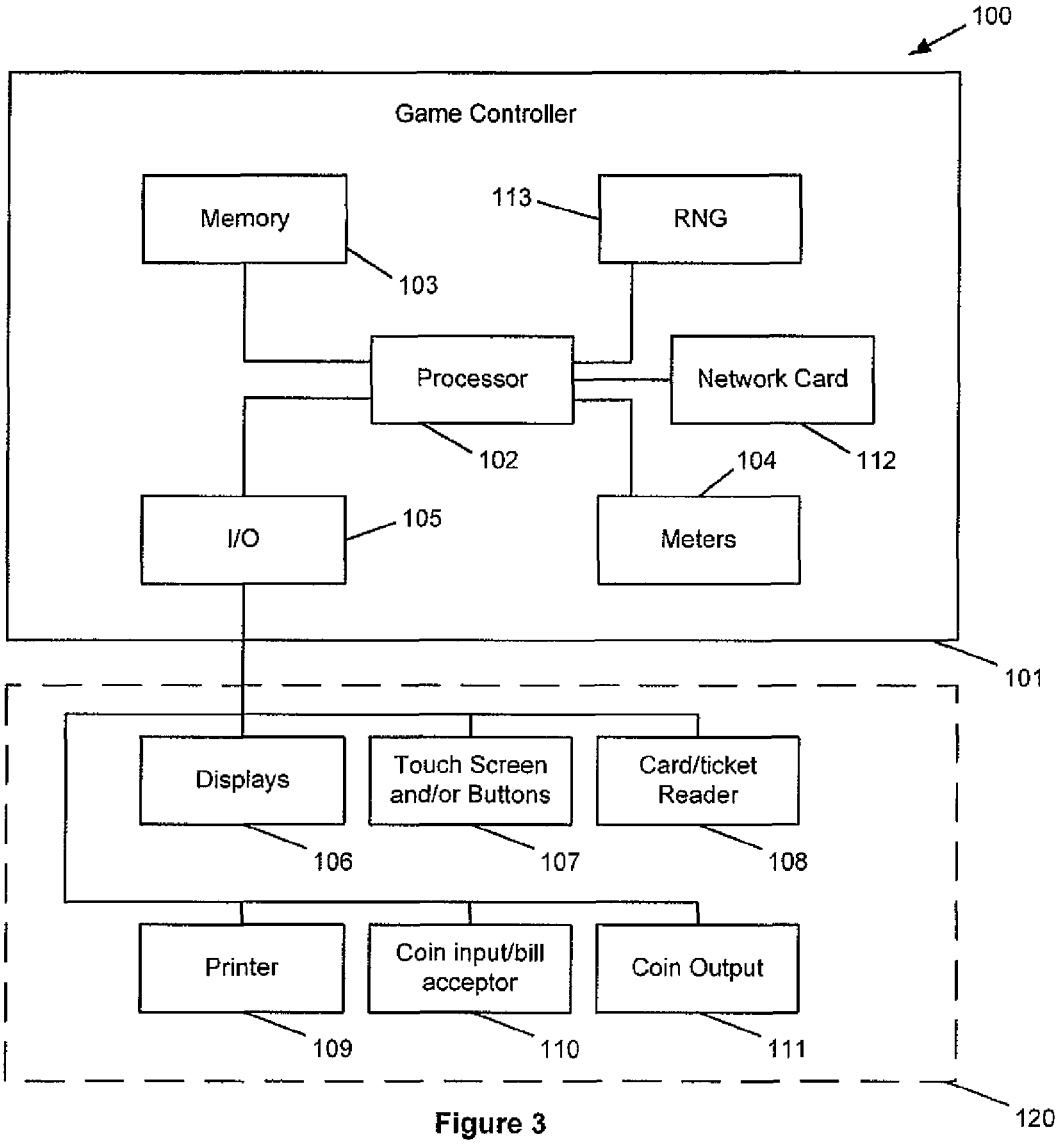
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 include one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
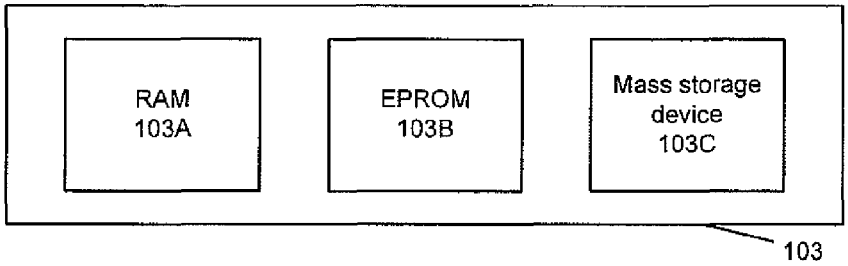
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
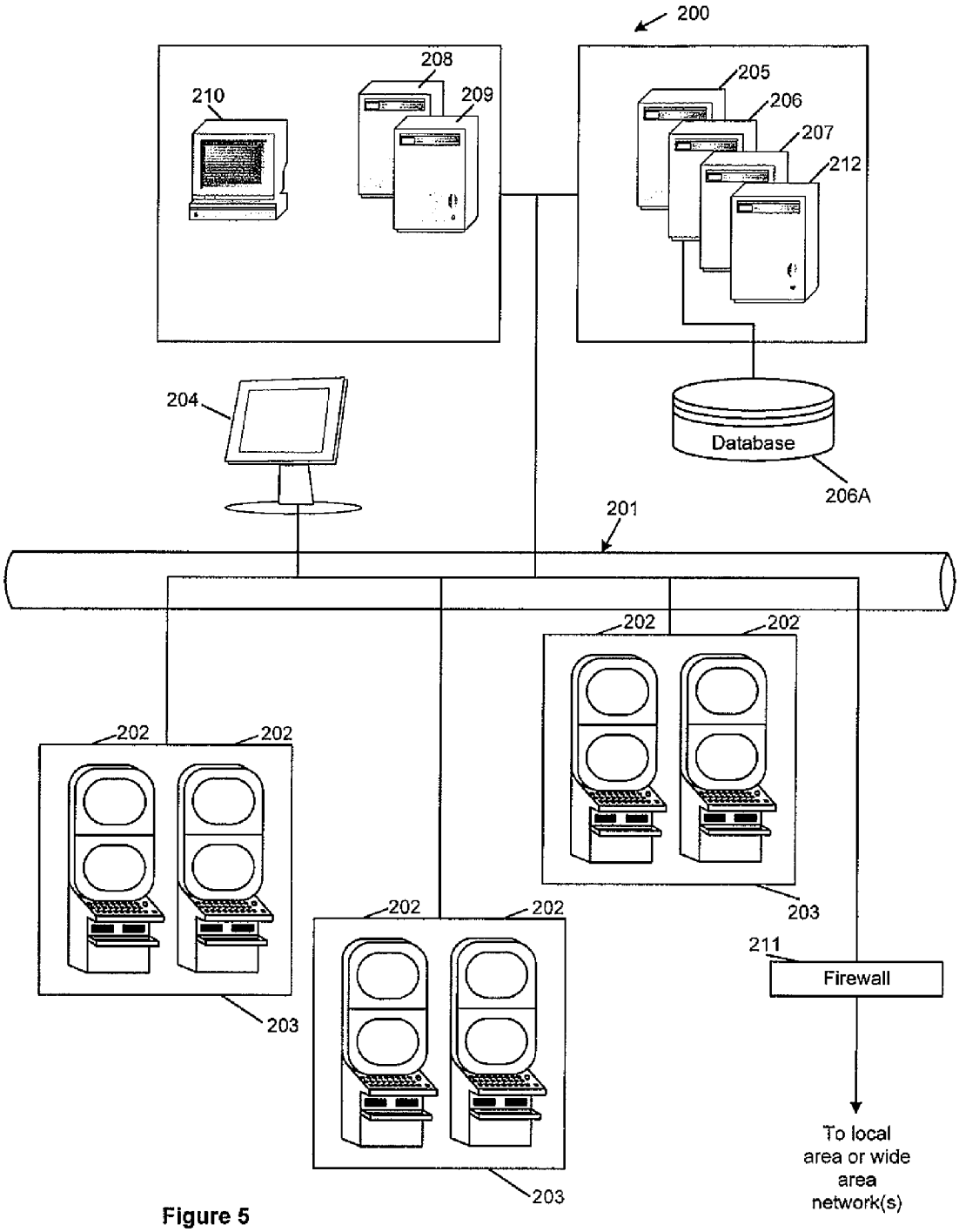
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games depending upon the terminals.

Figure 6:
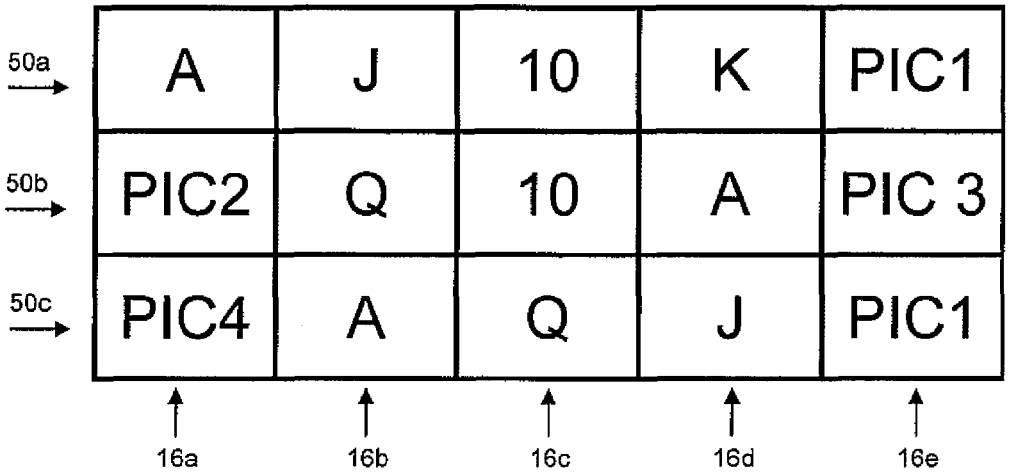
FIG. 6 is a view of a display according to one embodiment of the invention.

With reference to FIG. 6 display 16 of the gaming machine is shown which is a display showing virtual reels 16*a*, 16*b*, 16*c*, 16*d* and 16*e*. The display also has three lines or rows 50*a*, 50*b* and 50*c*. Thus, the display is typically a three by five virtual reel display in which the symbols in the reel 16*a* shown in FIG. 16 form a portion of a reel strip of the reel 16*a*. Typically, each reel strip will be made up of a number of symbols which may be anywhere from 20 to 200 or more and typically only a portion, usually 3 of those symbols of each reel strip are displayed on the display 16.

In order to play the game the player will insert coins into the machine or other forms of payment. The player can also select whether the player plays all lines 50*a* to 50*c* of the display or just one or two of those lines. In order to play the game, the reels 16*a* to 16*e* are spun and are stopped in turn to form a display of the symbols on the reel strips of each reel 16*a* to 16*e* such as is shown in FIG. 6. Typically, in a virtual reel system as distinguished from a mechanical reel system, the reels are made to spin by a graphic interface driver which selects images in response to a random number generator and displays them in sequence, for example, moving symbols downwardly on each of the reels 16*a* to 16*e* shown in FIG. 6 to give the appearance of a spinning type motion and then stops the reels so that three of the symbols on each of the reel strips associated with the reels 16*a* to 16*e* are displayed.

A win is determined based on the rules of the game which may include, for example, whether there is a predetermined number of the same symbol in a particular row or line. For example, if there are two aces, a pay out to the player may result, and if there are three aces a greater payout may result etc.

In accordance with an embodiment of the present invention, the player has the option of forming his or her own reel by making a selection of symbols. The player may be provided with this option in response to advancing to a particular level in a game such as a feature game, a particular payment made by the player such as an ante bet, or any other stimulus which may be used as a basis for determining that a player can now make his or her own reel. Alternatively, the player may be given the option at the start of the game to make his or her own reel. In this embodiment, the player made reel may not be active at all times. For example, the player made reel may only be active during a feature game even though specified at the beginning of a game session. The player's reel may remain active for an entire game session, for example until the gaming machine is inactive for a defined period or until a player's loyalty card is removed. Further, in some embodiments, the player may make a plurality of reels or the players selections may be incorporated into all of the reels as described in further detail below.

Figure 7:
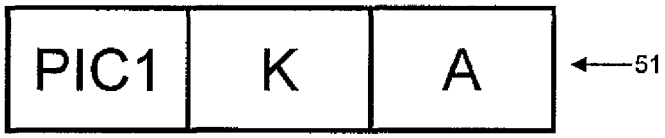
FIG. 7 is a view of a set of symbols to enable player selection.

As shown in FIG. 7 at the beginning of a game session, a set of player selectable symbols 51 is randomly generated by selection from a source set of symbols and displayed on the display 16 either in place of the display shown in FIG. 6 or merely as an overlay on the display shown in FIG. 6 or on another portion of the display 16 not occupied by the reels 16*a* to 16*e*.

One of the reels shown in FIG. 6 is pre-programmed to be the reel where it is displayed to the player that they are adding symbols to make their player's reel. In one example, this is because this is the only reel which can be made by the player and in this embodiment the reel 16*c* for example In other embodiments, the player may select which reel to make for example by paying for a specific reel. In still other embodiments, the added symbols may be added to each reel. In such an embodiment, the symbols to be used when the my reel function is active can be displayed separately to the reels 16.

In this embodiment, the user therefore selects one of the symbols from FIG. 7 such as the symbol PIC 1 and that symbol is located into the reel 16*c* in place of one of the symbols already present on the reel. The symbol PIC 1 need not necessarily form part of the display shown in FIG. 6 and simply could be allocated to another portion of the reel strip of the reel 16*c*, not visible in the display portion of the reel strip 16*c* shown in FIG. 6. Further, the selected symbols need not necessarily replace symbols of the existing reel strip but can be added to the reel strip. For example, if the reel has 22 symbols, and the added symbols may be appended after the twenty-second symbol. In one advantageous embodiment, five symbols are appended to the reel strip. Advantageously, the same five symbols can be added to each reel strip.

Figure 8:
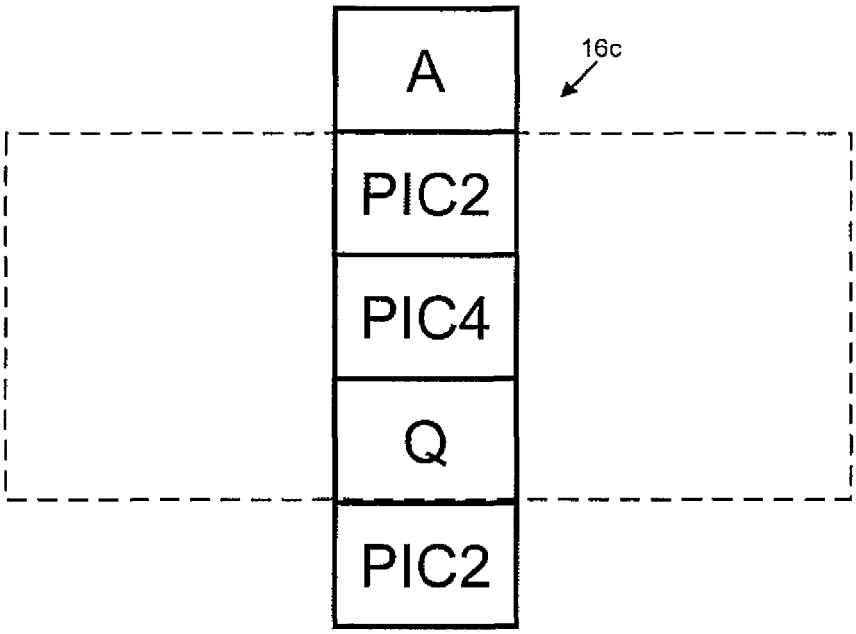
FIG. 8 shows the formation of a reel strip according to one embodiment of the invention.

A new group of symbols is then provided to the player by being randomly generated and is shown in FIG. 9. Again the player selects one of those symbols and that symbol is inserted into the reel strip of reel 16*c*. In this case the ace has been selected and is located into the reel strip of the reel 16*c* as shown in FIG. 8.

As is shown in FIGS. 10, 11 and 12, further sets of symbols are then displayed and the user selects one symbol from each set for insertion into the reel strip of the reel 16*c* shown in FIG. 5.

In alternative embodiments the above process may continue until a complete reel strip is formed in which all of the symbols on the reel strip are symbols selected by the player. Alternatively, the selected symbols may only include a portion of the reel strip or be appended to the reel strip.

The sets of symbols shown in FIG. 7 and FIG. 9 to 12 may be generated in a number of different ways. In a first embodiment the symbols are merely randomly generated and are selected by a random number generator. In other embodiments, various pathways (or rules) may be programmed into the machine for selection of the sets of symbols depending on the amount wagered by the player, the status of the game (that is whether the player has a reach a predetermined level in the game) or otherwise to control the likelihood of a player win using the player selected symbols.

When it is determined, that the player's reel is to be active, for example, when a feature game is triggered, the reels 16*a* to 16*e* are again spun and are stopped in turn so that the three lines 50*a*, 50*b* and 50*c* are displayed. Again the programme of the game determines whether there is a win from the displayed symbols and also based on the row or lines the player is playing.

In another embodiment, rather than locating the selected symbols into or appending them to an already formed reel strip, a blank reel strip may be provided as one of the reels 16*a* to 16*e* and the blank reel strip is filled in by the selected symbols from the sets of symbols shown in FIG. 7 and FIGS. 9 to 12.

Figure 13:
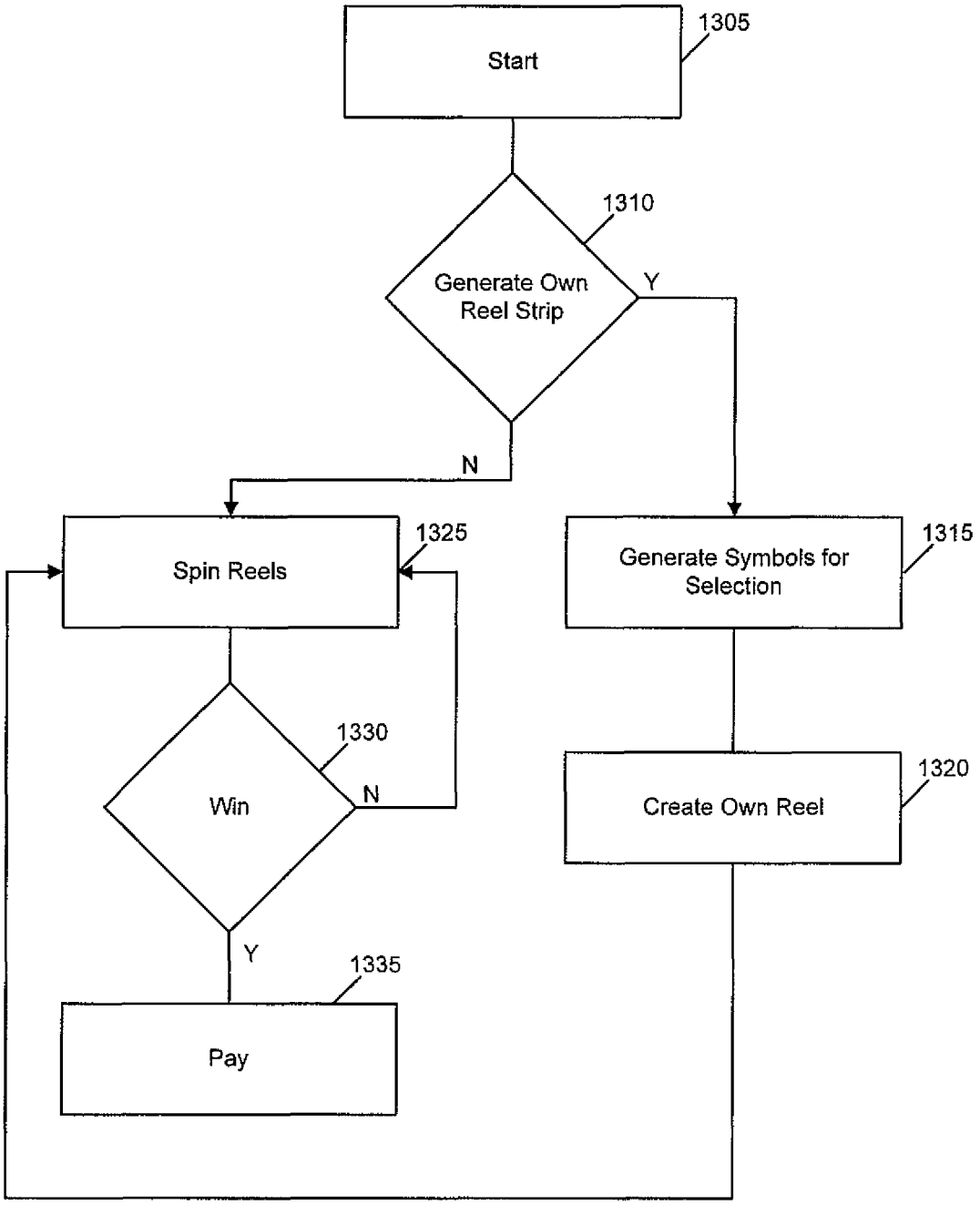
FIG. 13 is a flowchart relating to an embodiment of the invention.
Figure 14:
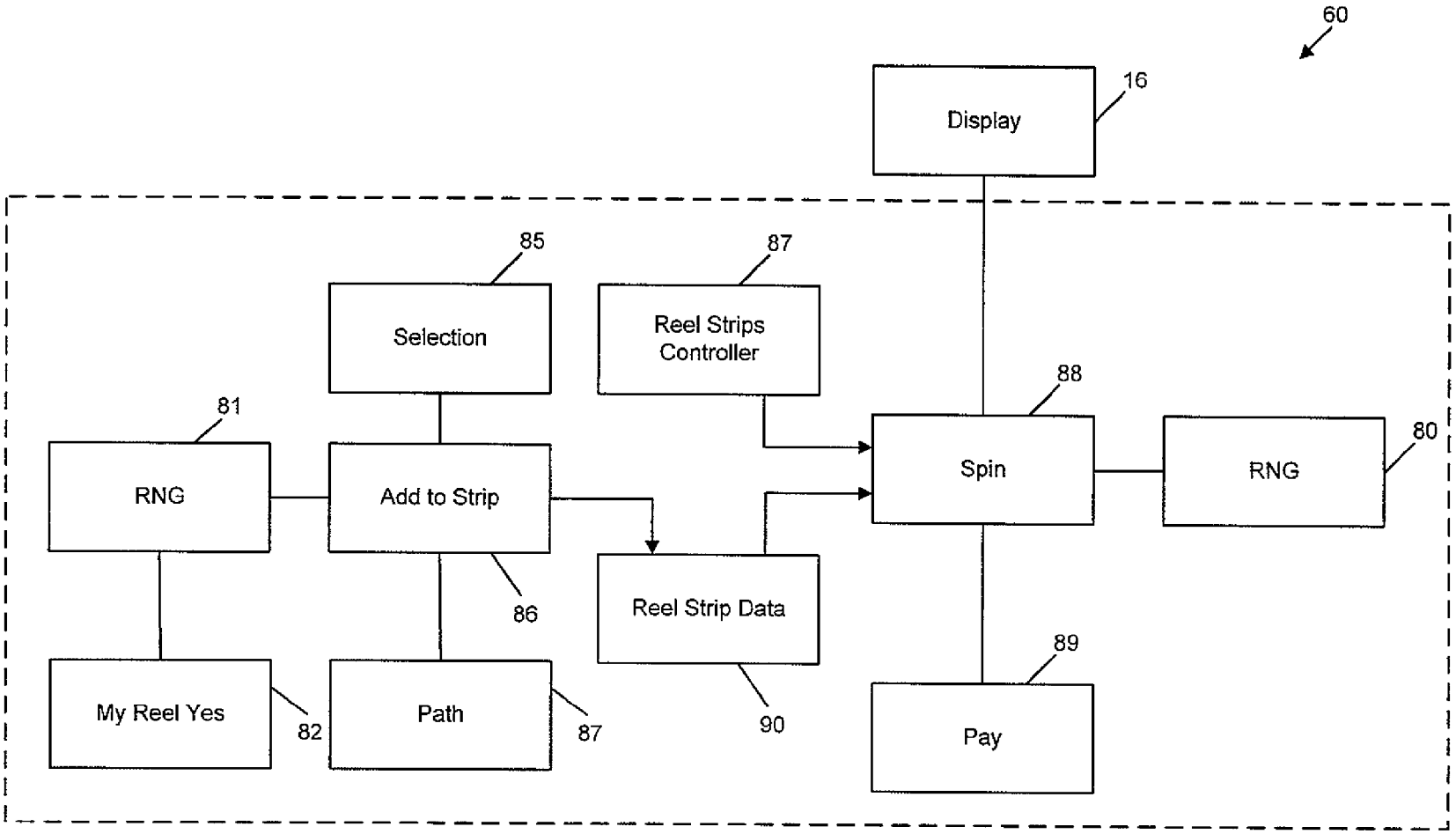
FIG. 14 is a functional modular block diagram relating to an embodiment of the invention.

FIGS. 13 and 14 show a flowchart and functional modular diagram relating to the embodiment of the invention. The flow chart assumes that the player's generated reel strip is active. Persons skilled in the art will appreciate that a display 16 is formed in response to a player initiating 1305 a play or spin 88 of the reels. In response to which the spin module 88, spins 1325 causes the selection of a stopping position for each reel. Typically, the symbols have defined sequence in a reel strip and a reel stop module 80 employs a random number generator selects a stopping position for the reel strips as specified by reel strip data 90 to form the displayed portions reel strips of the reel 16*a* to 16*e*.

The sets of user selectable symbols 51 are generated 1315 by selectable symbol module 81 using a random number generator under the control of the "form my reel" functional module 82 which identifies whether a reel is to be formed 1310 based on the eligibility requirements, for example based on reaching a stage in the game, such as feature game or in response to user input with a particular payment, or other stimuli. The random number generator 82 generates 1315 the various sets of symbols so that the user can select from those sets by input 1320 to module 85 to make the selection from each displayed set. This may be done by way of a touch screen where the user simply touches the symbol the user wishes to select, or pressing a button, keyboard entry or otherwise. Once the selection is made functional module 86 adds or appends that symbol into one of the reel strips and this is stored as reel strip data 90. In embodiments, where the player's reel is not always active, reel strip controller controls which reels are to be used at any time 87. For example, in an embodiment where the player selected symbols are appended to the end of each reel strip during free spins in a triggered feature game.

If the sets of symbols 51 are to be formed by a particular pathway rather than randomly, module 86 may be used to select the symbols based on the predetermined rules for the pathway or the module 87 may modify the selection generated by the random number generator 81.

Once the reel has been formed by the player and is to be used in a spin, the reels are spun 1325 at module 88 and are stopped in sequence and the reels are evaluated 1330 to see of there is a win at module 89 before the win is ultimately paid 1335.

Since modifications within the spirit and scope of the invention may readily be effected by persons skilled within the art, it is to be understood that this invention is not limited to the particular embodiment described by way of example hereinabove.

In the claims which follow and in the preceding description of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Persons skilled in the art will appreciate that the method of the embodiment could be embodied in program code such that the game controller can be implemented by a processor executing the program code. The program code could be supplied in a number of ways, for example on a computer readable medium, such as a disc or a memory (for example, that could replace part of memory 103) or as a data signal (for example, by downloading it from a server).

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Method steps associated with certain embodiments may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A method of gaming in a gaming system, the method comprising:

receiving a wager from a player using a credit mechanism;

providing a set of player selectable symbols;

receiving a player selection of a symbol from the set of player selectable symbols;

appending the player selected symbol to a reel of a plurality of reels, each reel of the plurality of reels comprising a predefined number of existing symbols arranged in a predefined sequence thereon, the player selected symbol appended in a symbol position after the predefined sequence of existing symbols on the reel;

after appending, spinning the plurality of reels to generate a game outcome; and evaluating the game outcome to determine whether to make an award based on the wager.

2. A method as claimed in claim 1, comprising randomly generating the set of player selectable symbols from a source set of symbols.

3. A method as claimed in claim 1 wherein providing the set of player selectable symbols comprises generating a plurality of sets of player selectable symbols.

4. A method as claimed in claim 3, wherein the receiving a player selection of the symbol comprises allowing the player to select one symbol from each set of the plurality of sets of player selectable symbols.

5. A method as claimed in claim 4, wherein a new reel of symbols is formed from the selected symbols.

6. A method as claimed in claim 1, wherein appending the player selected symbol to the reel comprises appending the player selected symbol to each reel of the plurality of reels.

7. A method as claimed in claim 1, further comprising determining whether a condition is met prior to generating the game outcome.

8. A method as claimed in claim 7, wherein the condition is triggered such that the reel including the player selected symbol is employed in a feature game.

9. A game controller for a gaming system, the game controller configured to:

receive a wager from a player using a credit mechanism;

provide a set of player selectable symbols on a display;

receive a player selection of a symbol from the set of player selectable symbols;

append the player selected symbol to a reel of a plurality of reels, each reel of the plurality of reels comprising a predefined number of existing symbols arranged in a predefined sequence thereon, the player selected symbol appended in a symbol position after the predefined sequence of existing symbols on the reel;

after appending, spin the plurality of reels to generate a game outcome; and evaluate the game outcome to determine whether to make an award based on the wager.

10. A game controller as claimed in claim 9, further configured to randomly generate the set of player selectable symbols from a source set of symbols.

11. A game controller as claimed in claim 9, further configured to provide the set of player selectable symbols by generating a plurality of sets of player selectable symbols.

12. A game controller as claimed in claim 11, further configured to allow the player to select one symbol from each set of the plurality of sets of player selectable symbols.

13. A game controller as claimed in claim 12 further configured to form a new reel of symbols from the selected symbols.

14. A game controller as claimed in claim 9, further configured to append the player selected symbol in each reel of the plurality of reels.

15. A game controller as claimed in claim 9, further configured to determine whether a condition is met prior to generating the game outcome.

16. A game controller as claimed in claim 15, wherein the condition is triggered such that the reel including the player selected symbol is employed in a feature game.

17. A game controller as claimed in claim 9, implemented by a processor executing program code stored in a memory.

18. A gaming system comprising:

a player interface comprising a display for displaying game outcomes, a credit mechanism for receiving wagers, and a game play mechanism; and a game controller configured to:

receive a wager using the credit mechanism;

provide a set of player selectable symbols for selection by displaying the set of player selectable symbols on the display;

receive, from the game play mechanism, a player selection of a symbol from the set of symbols; append the player selected symbol to a reel of a plurality of reels, each reel of the plurality of reels comprising a predefined number of existing symbols arranged in a predefined sequence thereon, the player selected symbol appended in a symbol position after the predefined sequence of existing symbols on the reel;

after appending, spinning the plurality of reels to generate a game outcome; and evaluate the game outcome to determine whether to make an award based on the wager.

19. A gaming system as claimed in claim 18, wherein the game controller is further configured to randomly generate the set of player selectable symbols from a source set of symbols.

20. A gaming system as claimed in claim 18, wherein the game controller is further configured to provide the set of player selectable symbols by generating a plurality of sets of player selectable symbols.

21. A gaming system claimed in claim 20, wherein the game controller is further configured to allow a player to select one symbol from each set of the plurality of sets of player selectable symbols.

22. A gaming system as claimed in claim 21, wherein the game controller is further configured to form a new reel of symbols from the selected symbols.

23. A gaming system as claimed in claim 18, wherein the game controller is further configured to append the player selected symbol to each of the plurality of reels.

24. A gaming system as claimed in claim 18, wherein the game controller is further configured to determine whether a condition is met prior to generating the game outcome.

25. A gaming system as claimed in claim 24, wherein the condition is triggered such that the reel including the player selected symbol is employed in a feature game.

26. A gaming system as claimed in claim 18, comprising a processor executing program code stored in a memory to implement the game controller.

27. A computer readable medium comprising computer program code that, when executed by a processor, implements a method of gaming, the method comprising:

receiving a wager from a player using a credit mechanism;

providing a set of player selectable symbols;

receiving a player selection of a symbol from the set of player selectable symbols;

appending the player selected symbol to a reel of a plurality of reels, each reel of the plurality of reels comprising a predefined number of existing symbols arranged in a predefined sequence thereon, the player selected symbol appended in a symbol position after the predefined sequence of existing symbols on the reel;

after appending, spinning the plurality of reels to generate a game outcome; and evaluating the game outcome to determine whether to make an award based on the wager.

28. The method as claimed in claim 1, wherein the symbol selected by the player comprises a blank symbol position, the method further comprising:

receiving a second player selection of a second symbol from the set of player selectable symbols after spinning the plurality of reels; and displaying the second symbol in the blank symbol position.

29. The game controller as claimed in claim 9, wherein the symbol selected by the player comprises a blank symbol position, the game controller further configured to:

receive a second player selection of a second symbol from the set of player selectable symbols after the plurality of reels are spun; and display the second symbol in the blank symbol position.

30. The gaming system as claimed in claim 18, wherein the symbol selected by the player comprises a blank symbol position, and wherein the game controller is further configured to:

receive, from the game play mechanism, a second player selection of a second symbol from the set of player selectable symbols after the plurality of reels are spun; and display the second symbol in the blank symbol position.

31. A method of gaming in a gaming system, the method comprising:

receiving a wager from a player using a credit mechanism;

providing a set of player selectable symbols;

receiving a player selection of a symbol from the set of player selectable symbols;

adding the player selected symbol to a reel of a plurality of reels, each reel of the plurality of reels comprising a predefined number of symbol positions arranged in a predefined sequence thereon;

after adding the player selected symbol, spinning the plurality of reels to generate a game outcome; and evaluating the game outcome to determine whether to make an award based on the wager.

32. The method of claim 31, wherein adding the player selected symbol to the reel comprises replacing a blank symbol position of the predefined number of symbol positions with the player selected symbol.

33. The method of claim 31, wherein adding the player selected symbol to the reel comprises appending the player selected symbol in a symbol position after the predefined sequence of symbol positions.

34. The method of claim 31 further comprising adding the player selected symbol to each reel of the plurality of reels.

* * * * *